United States Patent [19]

Inoue

[11] 4,451,109

[45] May 29, 1984

[54] CONNECTOR TERMINAL

[75] Inventor: Nori Inoue, Suzuka, Japan

[73] Assignee: Tokai Electric Wire Company Limited, Yokkaichi, Japan

[21] Appl. No.: 378,720

[22] Filed: May 17, 1982

[30] Foreign Application Priority Data

Feb. 10, 1981 [JP] Japan ..... 56-17431

[51] Int. Cl.[3] ..... H01R 11/22

[52] U.S. Cl. ..... 339/258 S; 339/256 SP

[58] Field of Search ..... 339/258, 97 R, 97 P, 339/256 SP, 99 R, 258 S, 258 F

[56] References Cited

U.S. PATENT DOCUMENTS

| | | | |
|---|---|---|---|
| 2,997,685 | 8/1961 | Anderson | 339/256 SP |
| 3,431,545 | 3/1969 | Kirby | 339/258 P |
| 3,977,754 | 8/1976 | Brummans | 339/99 R |
| 4,097,109 | 6/1978 | Cross | 339/258 F X |
| 4,169,646 | 10/1979 | Stape et al. | 339/99 R |
| 4,191,442 | 3/1980 | Caveney et al. | 339/99 R |

FOREIGN PATENT DOCUMENTS

| | | | |
|---|---|---|---|
| 52-3187 | 1/1977 | Japan | 339/99 R |
| 56-4185 | 1/1981 | Japan | 339/258 S |
| 56-4186 | 1/1981 | Japan | 339/258 |
| 2037494 | 7/1980 | United Kingdom | 339/97 R |

*Primary Examiner*—William R. Briggs

*Attorney, Agent, or Firm*—Cushman, Darby & Cushman

[57] ABSTRACT

A connector terminal for use in a junction block having conductor strips constituting the conductive paths. The connector terminal has a base plate, a pair of side walls extending from both side edges of the base plate substantially at a right angle to the plane of the base plate, each side wall having slots extending downwardly from the upper end thereof and adapted to receive a portion of the conductor strip, and a resilient tongue projected from the upper end of the base plate. The resilient tongue has a curved portion extending from the upper end of the base plate and curved to convex upwardly and a linear portion connected to the curved portion and extending obliquely downwardly toward the slots.

3 Claims, 11 Drawing Figures

CONNECTOR TERMINAL

FIELD OF THE INVENTION

The present invention relates to a connector terminal for use in electric wiring in automobiles or the like and, more particularly, to a connector terminal for connecting tab-like contact portion of a fuse or a relay to a conductive member thereby to electrically connect the fuse or the relay between wiring conductor members in a junction block such as a fuse box, relay box or a fuse/-relay box in electric wiring in automobiles or the like.

DESCRIPTION OF THE PRIOR ART

Figure 1:
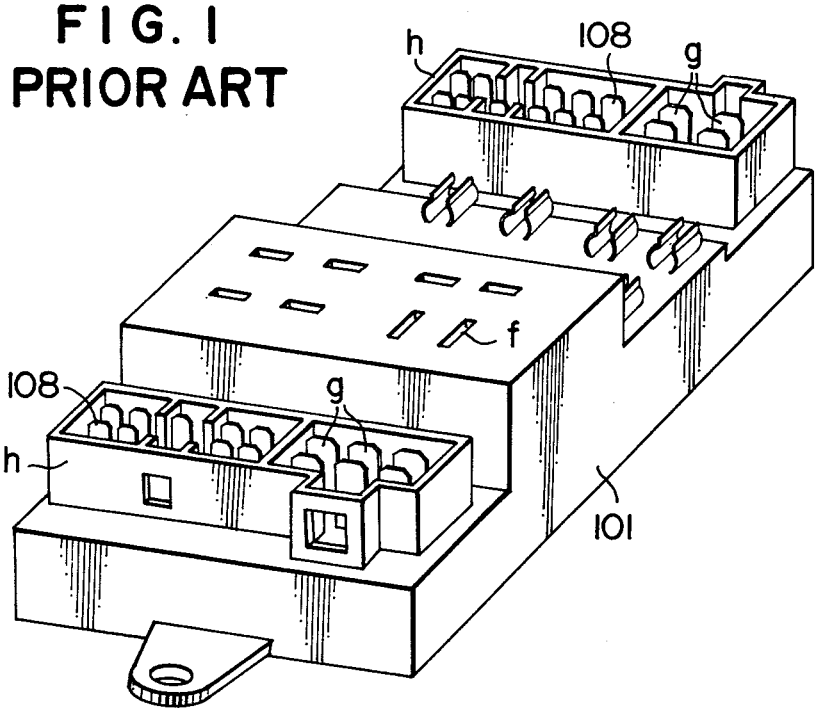
FIG. 1 PRIOR ART
FIG. 1 is a perspective view of the whole structure of a conventional junction block.
Figure 2:
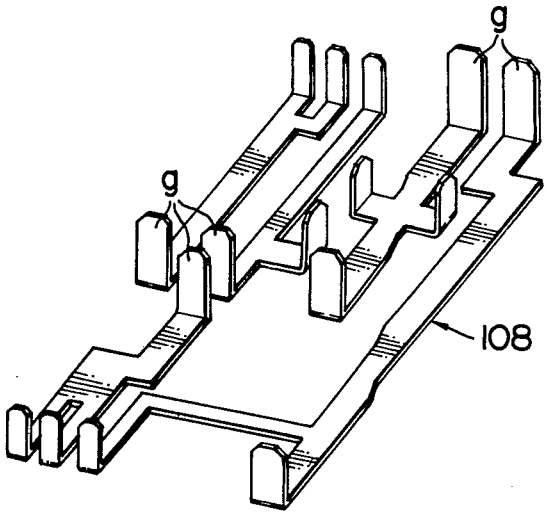
FIG. 2 PRIOR ART
FIG. 2 is a perspective view of a conductive member incorporated in the junction block.

Hitherto, a connection device referred to as "junction block" is widely used for a concentric connection of electric wirings extending from various electric parts mounted on automobile. As shown in FIG. 1, the junction block has an insulation box 101 accomodating a multiplicity of conductive members 108. Each conductive member 108 is generally referred to as BUS BAR and is produced by punching from a metal sheet in a complicated shape as shown in FIG. 2 and bending the ends to form contact terminals (g). These conductive members 108 are superposed in layers through the medium of insulators and accomodated in the insulation box 101. The contact terminals (g) of the conductive member 108 are exposed to the outside through sockets (h) of the insulation box 101. The insulation box 101 is provided with slits (f) for receiving a male type contactor or a tab-like contactor 110 (See FIG. 4) of a relay, fuse or the like.

Figure 4:
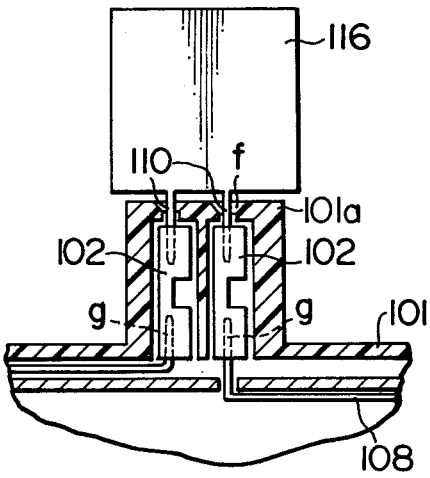
FIG. 4 PRIOR ART
FIG. 4 is a partial sectional view of the connector terminal shown in FIG. 3 in the state of use.
Figure 3:
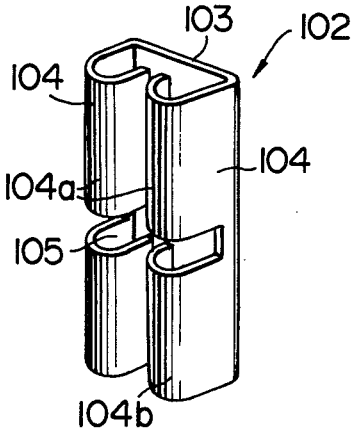
FIG. 3 PRIOR ART
FIG. 3 is a perspective view of a conventional connector terminal incorporated in the conventional junction block.
Figure 5:
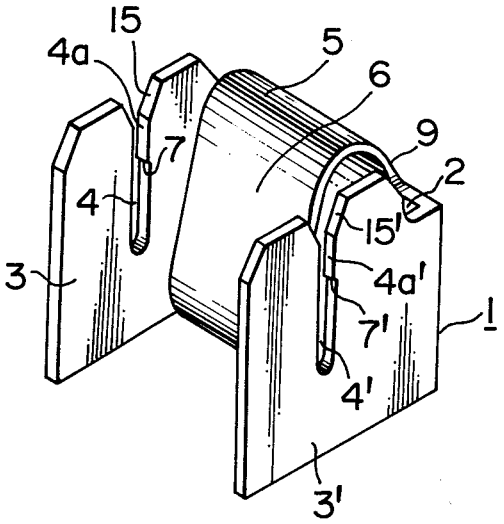
FIG. 5 is a perspective view of a connector terminal in accordance with the invention.
Figure 6:
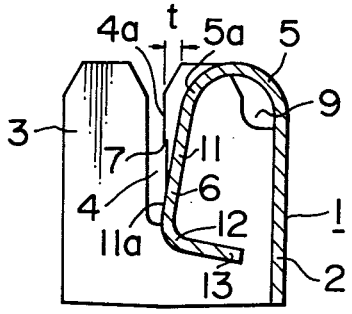
FIG. 6 is a cross-sectional view of the connector terminal shown in FIG. 5.

FIG. 3 shows a connector terminal 102 for use in the conventional junction block described above. This connector terminal 102 has a base plate 103 and side walls 104 which are curved and divided in the vertical direction into two parts by central notches 105. As shown in FIG. 4, the connector terminal 102 is accomodated by a connector terminal receptacle 101*a* in the junction block 101 as shown in FIG. 4. The space defined by the base plate 103 and the lower portions 104*b* of both side walls 104 receives the contact terminal (g) of the conductive member 108, while a space defined between the upper portions 104*a* of the side walls 104 and the base plate 103 receive the tab-like contactor 110 of a relay or a fuse 116.

The present inventor has made an intense study on the above-described junction block to improve the same. The junction block of the type described has a drawback that a troublesome work is required for stacking in layers a multiplicity of conductive members 108 punched out in various forms and for setting the layers of conductive members 108 in the insulation box.

Under this circumstance, the present inventor has succeeded in developing a junction block which can easily be assembled by inserting in order a multiplicity of web-like conductor pieces into right places in the insulation box. This type of junction block is disclosed in the specification of co-pending U.S. application Ser. No. 321,228 filed on Nov. 13, 1981.

The development of the junction block incorporating conductor strips by the present inventor has given a rise to the demand for connector terminals suited for use in combination with such a junction block. Namely, the conventional connector terminal shown in FIG. 3 is designed and constructed to receive male terminals, i.e. contact terminal (g) and tab-like contactor 110 which have comparatively small widths, and cannot be used in combination with the junction block incorporating conductor strips.

SUMMARY OF THE INVENTION

Accordingly, an object of the invention is to provide a connector terminal suited for use in combination with a junction block incroporating conductor strips and capable of easily forming a fuse circuit or a relay circuit between conductor strips.

To this end, according to the invention, there is provided a connector terminal comprising: a base plate; a pair of opposing side walls extending from both side edges of said base plate substantially at a right angle to the major surface of the base plate; a slot formed in each side wall and extending substantially in parallel with the base plate from one end of the side wall over a predetermined length, the slots in both side walls being substantially in alignment with each other; and a resilient tongue extending from the upper end of the base plate to the space within both side walls, the resilient tongue including a curved portion extending in such a curved manner as to convex toward the upper side into the space and terminating at a terminal end which is located at a position slightly offset from the inner surfaces of the slots adjacent to the resilient tongues towards the base plate, and a linear portion extending obliquely downwardly toward the slots.

The above and other objects, advantages and features of the invention will become clear from the following description of the preferred embodiments taken in conjunction with FIGS. 5 thru 11.

DESCRIPTION OF THE PREFERRED EMBODIMENT

Referring to FIGS. 5 to 9, a relay terminal 1 has a base plate 2, a pair of opposing side walls 3, 3' extending from both side edges of the base plate 2 substantially at a right angle to the base plate 2 and a resilient tongue 6 which extends from the upper end of the base plate 2, extending through an upwardly projected curved portion 5 downwardly through the space defined between the side walls 3, 3'. Slots 4, 4' are formed in respective side walls 3, 3' at substantially widthwise mid portions of these side walls 3, 3' so as to extend downwardly over a predetermined length from the upper ends of the side walls 3, 3'. These slots 4, 4' are substantially in alignment with each other. The upper end openings 15, 15' of the slots 4, 4' diverge upwardly. Steps 7, 7' are formed on the inner surfaces 4a, 4a' of the slots adjacent to the base plate 2. The steps 7, 7' are formed deep in the slots 4, 4', more specifically substantially at the longitudinal or depthwise portions of respective slots 4, 4'. The width of the each slot is greater at the portion thereof below the step than at the portion thereof above the step.

The slots 4, 4' are adapted to receive conductor strip 8 constituting a conductive path and to hold the same in such a manner than it bridges both side walls 3, 3' horizontally.

The upwardly diverging upper end openings 15, 15' of the slots 4, 4' serve to guide the conductor strips 8 when the latter is inserted into the slots 4, 4', while the wide gaps below the steps 7, 7' in the slots 4, 4' function to permit the conductor strip 8 to be fitted into the slots 4, 4' with a comparatively small pressing force. The upper ends of the side walls 3, 3' project above the upper end of the base plate 2 and are connected to the upper end of the base plate 2 through notched parts 9.

The top end of the curved portion 5 of the tongue 6 extending from the upper end of the base plate 2 takes the same level as the upper ends of the side walls 3, 3' and the arc of the curved portion 5 is slightly smaller than the arc of a semi-circle. The terminal end portion 5a (See FIG. 6) of the curved portion 5 is located at the right side of the slots 4, 4' as viewed in FIG. 6, such that the distance between the terminal end 5a and the conductor strip 8 received by the slots 4, 4' and held by the side walls 3, 3' is substantially equal to or slightly greater than the plate thickness of the tab-like contactor 10 (See FIG. 7) of a fuse or a relay which will be described later. The tongue 6 has a linear portion 11 which extends downwardly from the terminal end 5a of the curved portion 5. The linear portion extends downwardly in such a manner as to gradually get apart from the base plate 2 and that the distance from the conductor strip 8 is gradually decreased toward the lower side. The tongue 6 further has a bent portion 12 which is positioned slightly below the portion of the tongue 6 engaging with the conductor strip 8 and bent towards the base plate 2 and a linear portion 13 which extends obliquely downwardly from the bent portion 12.

As stated before, the tongue 6 has a curved portion 5, linear portion 11 and a linear portion 13. As will be clear from the foregoing description, the distance (t) between the terminal end 5a of the curved portion 5 and the inner surface 4a of the slot 4 adjacent to the terminal portion 5a, i.e. adjacent to the base plate, is selected to be substantially equal to or slightly greater than the plate thickness of the tab-shaped contactor 10 (See FIG. 7). The engaging portion 11a of the linear portion 11 extends into the space inside of the lower part of the slot 4 beyond the above-mentioned inner surface. The linear portion 11 extends obliquely from the terminal end portion 5a to a position slightly lower than the engaging portion 11a. The above-explained relative positions of the terminal end 5a, engaging portion 11a and the slot 4 are indentical to the relative positions of the terminal end 5a, engaging portion 11a and the slot 4. The curve portion 5 imparts a suitable resiliency to the tongue 6 to permit the latter to function as a spring. The conductor strip 8 received by the slots 4, 4' of the connector terminal 1 and extended between the side walls 3 and 3' constitute, in combination with the tongue 6 and the side walls 3, 3', a receptacle for receiving a male contactor or a tab-shaped contactor 10 of a fuse or a relay, so that the tab-shaped contactor 10 is clamped resiliently between the conductor strip 8 and the resilient tongue 6.

As has been described, according to the invention, the connector terminal 1 form a receptacle for the tab-like contactor 10 in cooperation with the conductor strip 8. In the actual use, the connector terminals are attached to the adjacent ends of two conductor strip 8 aligned linearly with each other, so as to receive a pair of tab-like contactors 10 of a blade-type fuse 16 (See FIG. 7) thereby to complete a fuse circuit between two conductive pieces 8.

Figure 11:
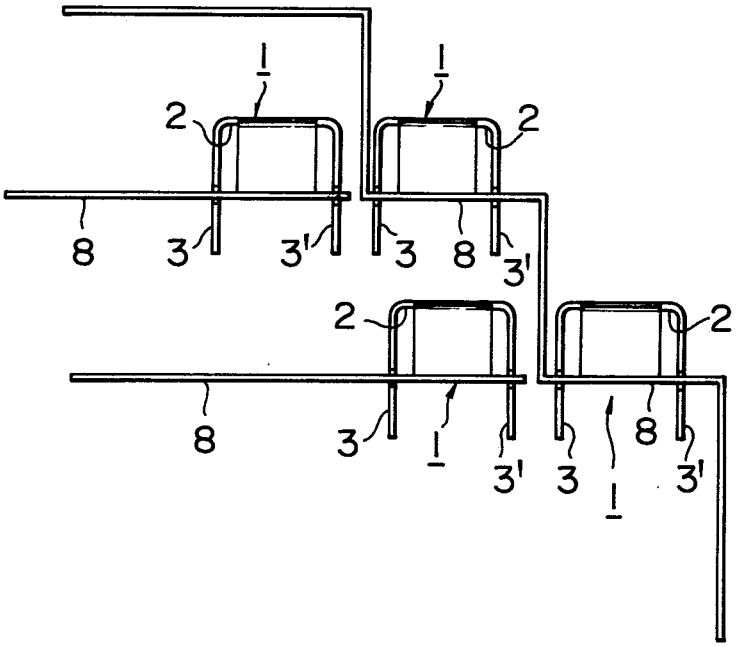
FIG. 11 is a schematic illustration of another example of arrangement of a plurality of conductor strips and connector terminals.

FIG. 11 schematically shows another example of arrangement of the conductor strips 8 in which one 8 of the conductor strips 8 is bent at several portions thereof while the other conductor strip 8 is arranged to extend along the extension of the linear portion extending from the bent portion. The connector terminals are attached to the linearly aligned portions of the conductor strips 8, 8' to receive respective tab-like contactors 10 of the above-mentioned blade type fuse.

In the actual use, a multiplicity of conductor strips 8 are arranged in the insulation box in a manner shown, for example, in the aforementioned co-pending U.S. application Ser. No. 321,228.

Figure 7:
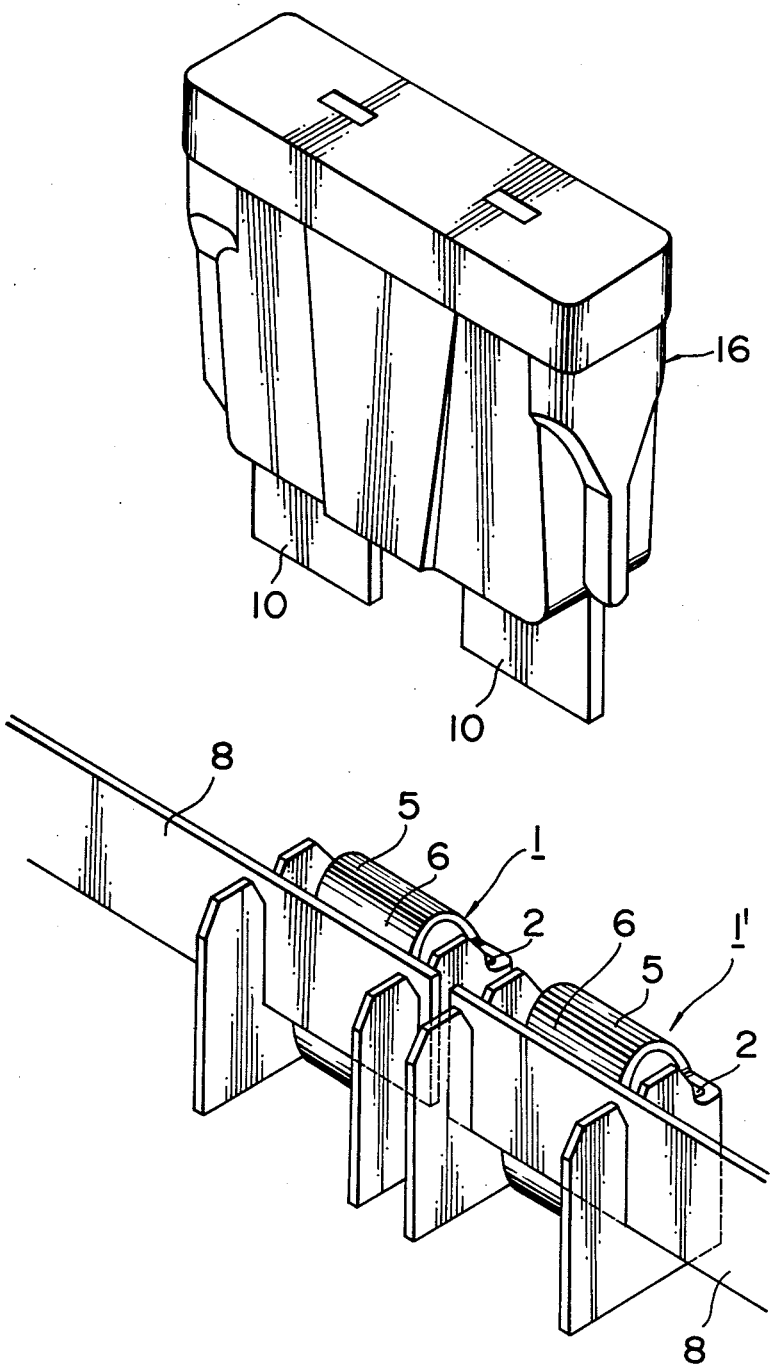
FIG. 7 is a perspective view of the connector terminal shown in FIG. 5 incorporating a conductor strip, in the state before the connection of a blade type fuse to the conductor strip.
Figure 8:
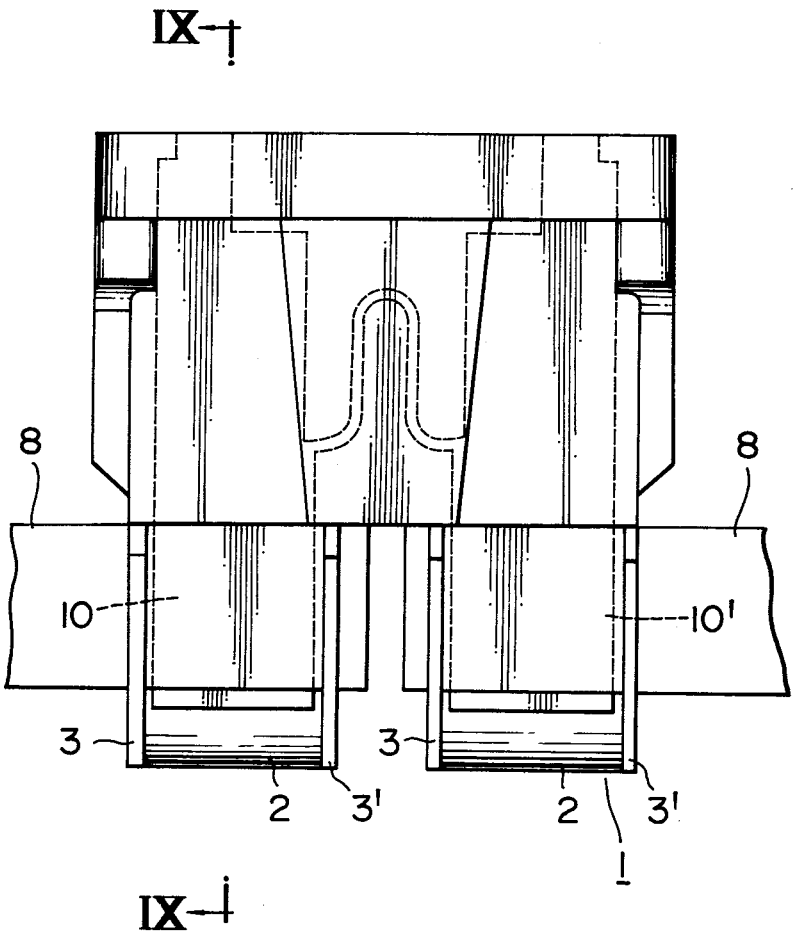
FIG. 8 is a front elevational view of the connector terminal incroporating a conductor strip with a blade type fuse connected thereto.
Figure 9:
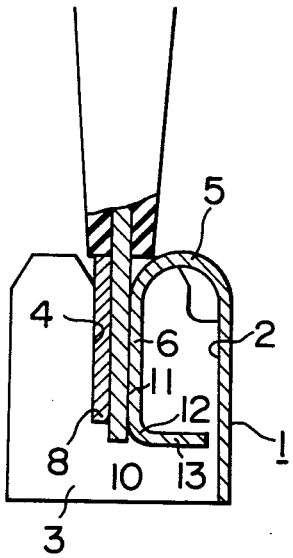
FIG. 9 is an illustration of the connector terminal as viewed in the direction of the arrow IX—IX in FIG. 8.
Figure 10:
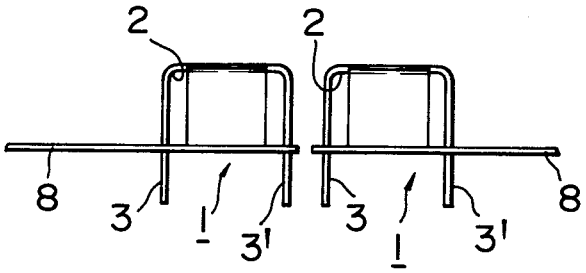
FIG. 10 is a schematic illustration of an example of the arrangement of a plurality of conductor strips and connector terminals.

As will be seen from the foregoing description, the connector terminal of the invention can effectively be used for connecting a fuse or a relay between a plurality of conductor strips in a junction block such as a fuse box, relay box or a fuse/relay box in which wiring conductive paths are constituted by conductor strips arranged in such a manner that the flat portions oppose to each other as shown in FIG. 7.

What is claimed is:

1. A connector terminal for use with a junction block incorporating therein a number of web-like conductor strips, comprising:

a base plate;

a pair of opposing side walls extending from both side edges of said base plate substantially at a right angle to the plane of said base plate;

slots formed in the respective side walls for receiving one of the conductor strips, each of said slots extending substantially in parallel with said base plate over a predetermined length from one end of each of said side walls, said slots being substantially in alignment with each other; and a resilient tongue extending from the upper end of said base plate into the space inside of said side walls, said resilient tongue including a curved portion extending from the upper end of said base plate into said space at such a curvature as to convex to the upper side and terminating at a terminal end located at a position slightly offset from the inner surfaces of said slots adjacent to said resilient tongue, and a linear portion extending obliquely downwardly toward said slots.

2. A connector terminal as claimed in claim 1, wherein each of said slots extends downwardly over a predetermined length from the upper end of each of said side walls.

3. A connector terminal as claimed in claim 2, wherein each of said slots has an upwardly diverging upper end portion, and intermediate portion of a smaller width and a lower portion of a larger width.

* * * * *